US006468131B1

(12) United States Patent
Korovin

(10) Patent No.: US 6,468,131 B1
(45) Date of Patent: Oct. 22, 2002

(54) METHOD TO MATHEMATICALLY CHARACTERIZE A MULTIZONE CARRIER

(75) Inventor: Nikolay Korovin, Phoenix, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 58 days.

(21) Appl. No.: 09/724,398

(22) Filed: Nov. 28, 2000

(51) Int. Cl.[7] ..... B24B 49/00
(52) U.S. Cl. ..... 451/5; 451/8; 451/9; 451/41
(58) Field of Search ..... 451/5, 8, 9, 41, 451/59

(56) References Cited

U.S. PATENT DOCUMENTS

| | | | | |
|---|---|---|---|---|
| 5,205,082 A | | 4/1993 | Shendon et al. | |
| 5,230,184 A | | 7/1993 | Bukhman | |
| 5,584,746 A | | 12/1996 | Tanaka et al. | |
| 5,584,751 A | | 12/1996 | Kobayashi et al. | |
| 5,595,526 A | * | 1/1997 | Yau et al. | 451/41 |
| 5,605,488 A | | 2/1997 | Ohashi et al. | |
| 5,624,299 A | | 4/1997 | Shendon | |
| 5,660,517 A | | 8/1997 | Thompson et al. | |
| 5,664,987 A | * | 9/1997 | Renteln | 451/21 |
| 5,681,215 A | | 10/1997 | Sherwood et al. | |
| 5,738,574 A | | 4/1998 | Tolles et al. | |
| 5,762,539 A | | 6/1998 | Nakashiba et al. | |
| 5,762,544 A | | 6/1998 | Zuniga et al. | |
| 5,762,546 A | | 6/1998 | James et al. | |
| 5,795,215 A | | 8/1998 | Guthrie et al. | |
| 5,820,448 A | | 10/1998 | Shamouilian et al. | |
| 5,823,854 A | * | 10/1998 | Chen | 451/285 |
| 5,964,653 A | | 10/1999 | Perlov et al. | |
| 6,093,089 A | | 7/2000 | Chen et al. | |
| 6,113,462 A | * | 9/2000 | Yang | 451/443 |
| 6,191,038 B1 | * | 2/2001 | Yoshida et al. | 438/691 |

FOREIGN PATENT DOCUMENTS

| | | |
|---|---|---|
| EP | 0 786 310 A1 | 7/1997 |
| EP | 0 790 100 A1 | 8/1997 |
| EP | 0 791 431 A1 | 8/1997 |
| EP | 0 841 123 A1 | 5/1998 |

* cited by examiner

*Primary Examiner*—Timothy V. Eley
*Assistant Examiner*—Alvin J Grant
(74) *Attorney, Agent, or Firm*—James L. Farmer

(57) ABSTRACT

In a method for mathematically characterizing a multizone CMP carrier, alternating zones are pressurized to a first pressure and the remaining zones are pressurized to a second lower pressure. A first wafer may then be polished using this combination of pressures and a first material removal profile may then be found. The pressures in the zones may then be reversed, and a second wafer may then be polished using this new combination of pressures, and a second material removal profile may then be found. Symmetrical points of intersection about the central axis of the carrier may be determined which identify the radius of each zone, and each point corresponds to a middle point for each transitional area between zones. The absolute values for the first derivatives for two pairs of symmetrical points may be averaged to determine a set of parameters that allow the multizone carrier to be mathematically characterized.

12 Claims, 6 Drawing Sheets

METHOD TO MATHEMATICALLY CHARACTERIZE A MULTIZONE CARRIER

TECHNICAL FIELD

The invention relates generally to semiconductor manufacturing, and more specifically to a method to mathematically characterize a multizone carrier used for retaining and pressing a semiconductor wafer against a polishing pad in a chemical-mechanical polishing tool.

BACKGROUND OF THE INVENTION

A flat disk or "wafer" of single crystal silicon is the basic substrate material in the semiconductor industry for the manufacture of integrated circuits. Semiconductor wafers are typically created by growing an elongated cylinder or boule of single crystal silicon and then slicing individual wafers from the cylinder. The slicing causes both faces of the wafer to be extremely rough. The front face of the wafer on which integrated circuitry is to be constructed must be extremely flat in order to facilitate reliable semiconductor junctions with subsequent layers of material applied to the wafer. Also, the material layers (deposited thin film layers usually made of metals for conductors or oxides for insulators) applied to the wafer while building interconnects for the integrated circuitry must also be made a uniform thickness.

Planarization is the process of removing projections and other imperfections to create a flat planar surface, both locally and globally, and/or the removal of material to create a uniform thickness for a deposited thin film layer on a wafer. Semiconductor wafers are planarized or polished to achieve a smooth, flat finish before performing process steps that create integrated circuitry or interconnects on the wafer. A considerable amount of effort in the manufacturing of modern complex, high density multilevel interconnects is devoted to the planarization of the individual layers of the interconnect structure. Nonplanar surfaces create poor optical resolution of subsequent photolithography processing steps. Poor optical resolution prohibits the printing of high density lines. Planar interconnect surface layers are required in the fabrication of modern high density integrated circuits. To this end, CMP tools have been developed to provide controlled planarization of both structured and unstructured wafers.

A carrier in a CMP tools is used to retain a wafer and press against the back surface of the wafer so that the front surface of the wafer is pressed against a polishing pad. Slurry may be used to enhance the removal rate or planarity of the process. The amount of pressure at each point on the back surface of the wafer directly affects the amount of pressure between each point on the front surface of the wafer and the polishing pad. This relationship is important because the polishing removal rate at each point on the front surface of the wafer is proportional to the pressure on that point.

In general, it is desirable to remove material from the front surface of the wafer in a substantially uniform manner by applying a uniform pressure on the back surface of the wafer. However, thickness variations in incoming wafers, nonuniform slurry distribution, different motions for different points on the front surface of the wafer and other problems cause nonuniform planarization results. The nonuniform planarization results are typically manifested as concentric bands on the front surface of the wafer were greater or lesser amounts of material were removed. It may therefore be desirable to have different pressures on different concentric bands to compensate for the nonuniform removal rate.

Carriers able to provide different pressures on different concentric bands on the back surface of the wafer are referred to as multizone carriers. Multizone carriers can affect the polishing removal rate by applying different polishing pressures on different zones thereby creating a pressure distribution profile. Multizone carriers are typically able to apply different pressures on different zones by having two or more plenums that may be individually pressurized. The individually pressurized plenums press against the back surface of the wafer in order to control the pressures on the front surface of the wafer. The pressures between the front surface of the wafer and the polishing pad control the polishing removal rate.

However, Applicant has discovered that the pressures placed on the back surface of the wafer by a multizone carrier do not directly correspond to the pressures between the front surface of the wafer and the polishing pad. This is particularly true for transition areas between zones. For example, while a sharp pressure differential may exist between plenums, i.e. zones, pressing on the back surface of the wafer, a relatively smooth pressure transitional area will exist on the front surface of the wafer. The pressures on the front, not the back, surface of the wafer control the material removal rate. It is therefore highly desirable to be able to predict the pressure on the front surface of the wafer knowing the applied pressures on the back surface of the wafer. However, there is no conventional method for predicting the pressure profile on the front surface of the wafer, particularly within the transitional area, knowing the pressures applied to the back surface of the wafer. In addition, there is no conventional method for determining the combination of pressures needed in the zones to optimize the required polishing removal profile.

What is needed is a method to mathematically characterize a multizone carrier so that the optimum combination of pressures may be determined and applied to different zones on the back surface thereby creating a desired removal rate profile on the front surface of the wafer.

SUMMARY OF THE INVENTION

The invention is a method for mathematically characterizing a multizone CMP carrier. This allows a material removal profile to be calculated for a particular multizone carrier given a combination of pressures for the zones within the carrier.

In a preferred embodiment, alternating zones are pressurized to a first pressure (Pmax) and the remaining zones are pressurized to a second lower pressure (Pmin). For example, pressures of Pmax, Pmin and Pmax may be used for zones 1, 2 and 3 respectively in a three-zone carrier. A first wafer may then be polished using this combination of pressures and a first material removal profile may be found for the first wafer using this combination of pressures.

The pressures in the zones may then be reversed, i.e. zones with Pmax are given Pmin and zones with Pmin are given Pmax. For example, pressures of Pmin, Pmax and Pmin may be used for zones 1, 2 and 3 respectively in a three-zone carrier. A second wafer may then be polished using this new combination of pressures and a second material removal profile may be found for the second wafer using this combination of pressures.

The data from the first and second material removal profiles is preferably normalized to assist in the mathematical analysis. Points of intersection between the first and second material removal profiles may be found which identify a radius of a zone and a middle point in a transitional area between zones. Each zone, except for the outermost zone, will have two points of intersection identifying the length and position of the diameter for that zone. The two points for each zone, assuming the multizone carrier has symmetrical plenums, may easily be identified because the two points will be roughly symmetrical with each other about the central axis of the carrier.

The pressure on the front surface of the wafer may be modeled as being uniform with the pressure applied to the back surface of the wafer with the exception of the transitional areas between zones. The transitional areas are preferably described by an exponential function to more accurately reflect the actual pressure distribution on the front surface of the wafer. The exponential function of the transition area may be completely specified by the first derivative (slope) taken in the middle of the transition area. Each zone, except for the outermost zone, has two transitional areas allowing four slopes in total to be found for each zone.

Alternatively, a first derivative for the first material removal profile and a first derivative for the second material removal profiles may be calculated. Inputting the two points of intersection identifying an outer diameter of a zone, one at a time, into the two derivatives, one at a time, produces four slopes for each transition area.

Using either method, the absolute value of the four slopes may be averaged together to find the average absolute value of the first derivative for the points of intersection ($RR^1$ (X0)) for that zone. This number, which is different for every multizone carrier and wafer combination, allows a set of four equations to be solved that mathematically characterize the transition areas on the front surface of the wafer.

BRIEF DESCRIPTION OF THE DRAWINGS

The present invention will hereinafter be described in conjunction with the appended drawing figures, wherein like numerals denote like elements, and.

DETAILED DESCRIPTION OF EXEMPLARY EMBODIMENTS

A method utilized in the polishing of semiconductor substrates and thin films formed thereon will now be described. In the following description, numerous specific details are set forth illustrating Applicant's best mode for practicing the present invention and enabling one of ordinary skill in the art to make and use the present invention. It will be obvious, however, to one skilled in the art that the present invention may be practiced without these specific details. In other instances, well-known machines and process steps have not been described in particular detail in order to avoid unnecessarily obscuring the present invention.

The removal rate profile of a multizone carrier is dependent on the location of its zones, the uniformity of polishing within the zones, the cross-effect between zones and the pressure within each zone. The invention is a method to mathematically characterize the substantially fixed aspects of a multizone carrier, i.e. the location of the zones, the uniformity of polishing within the zones and the cross-effect between zones. Once the multizone carrier has been mathematically characterized, various combinations of pressure for the zones may be input to calculate an expected pressure between every point on the front surface of the wafer and the polishing pad. The expected pressure between the wafer and polishing pad is important since it is directly proportional to the material removal profile on the front surface of the wafer.

Figure 10:
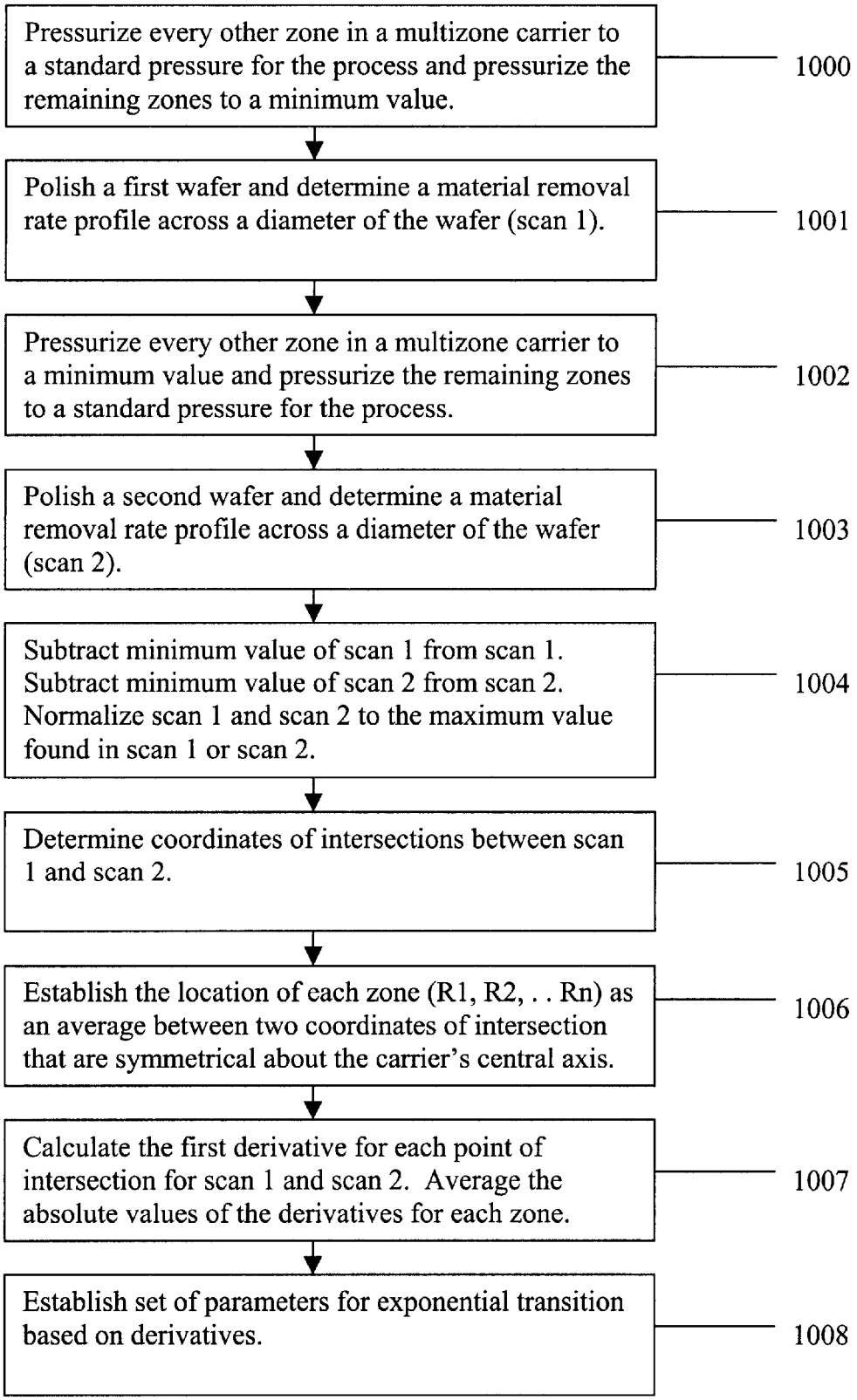
FIG. 10 is a flow chart of the preferred method of mathematically characterizing a multizone carrier.

Three different models, given in order of increasing accuracy, of a multizone carrier will be used to explain how a multizone carrier may be mathematically characterized; a Model without Transition, a Model with Linear Transition and a Model with Exponential Transition. The three models will now be disclosed with continuing reference to the flowchart of FIG. 10.

Model without Transition

Figure 1:
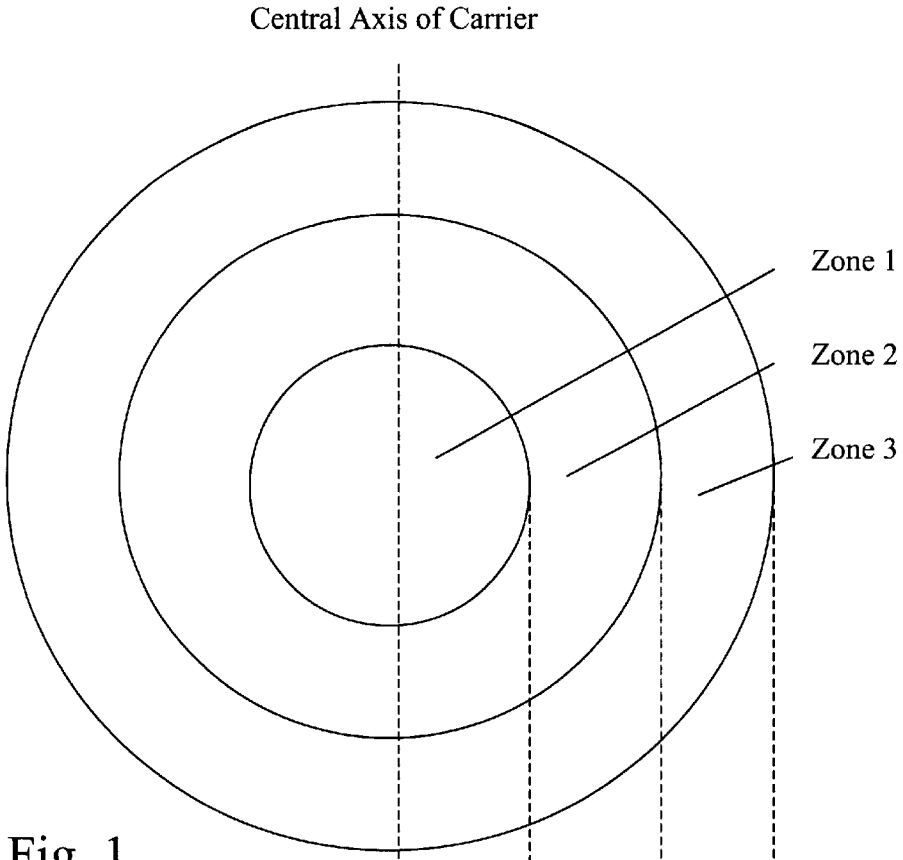
FIG. 1 is a simplified bottom plan view of a multizone carrier having three zones.
Figure 2:
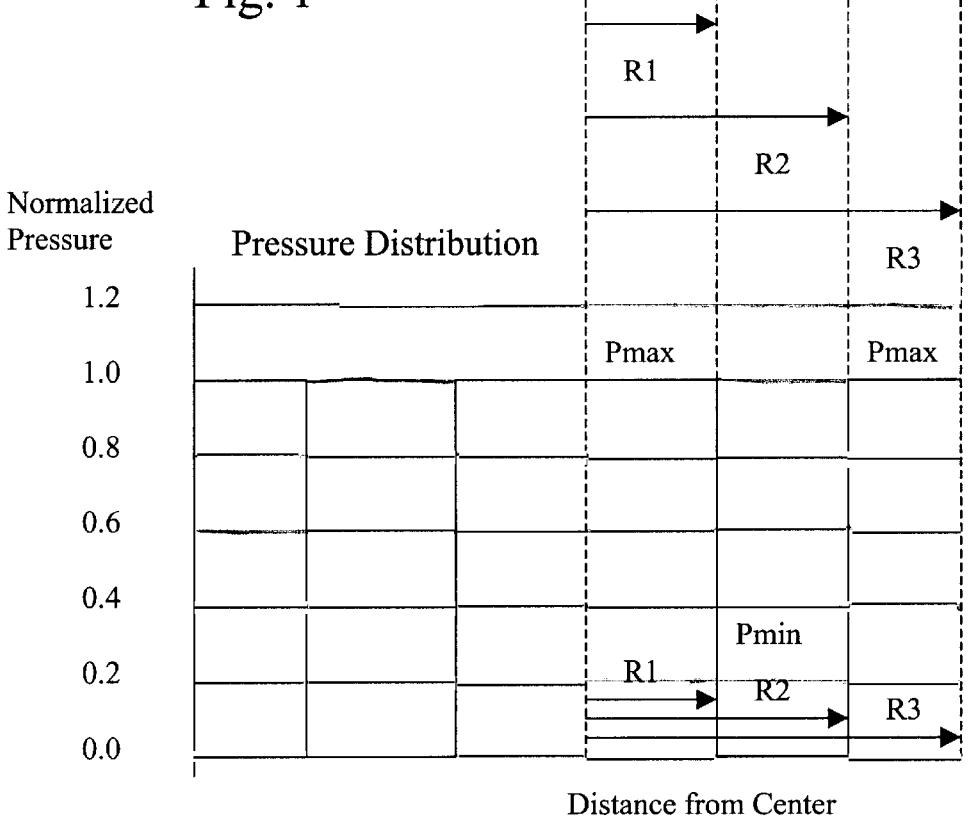
FIG. 2 is a Pressure Distribution chart illustrating a Model without Transition of a possible pressure distribution on the front surface of a wafer.

FIGS. 1 and 2 illustrate a simple model that may be used to mathematically characterize a multizone carrier having three zones. The multizone carrier has a central zone 1 surrounded by concentric zones 2 and 3. While this model (and the other models discussed below) is discussed using a multizone carrier having three zones, it should be understood that the invention may be practiced using multizone carriers having two or more zones.

This model assumes that the pressure on the front surface of the wafer is directly proportional to, or the same as, the pressure applied by each zone in the multizone carrier. This model is useful in determining the geometric locations of the zones (R1, R2, . . . R3, Rn where n is the number of zones) in a multizone carrier. Normally, the outer-diameter radius (Rn) of the outermost zone will be close to the radius of the wafer.

The first step is to pressurize a first set of zones in a multizone carrier to a first polishing pressure (Pmax) and to pressurize the remaining zones to a second polishing pressure (Pmin). Pmax should be greater than Pmin (step 1000). Pmax is preferably the pressure equal to the pressure from the best known recipe currently being used and Pmin is preferably about the lowest (usually about 0 psi) pressure that may be used. Also, Pmax is preferably high enough to produce at least the desired removal rate for the given process and Pmin is preferably low enough to produce a removal rate substantially below the desired removal rate. The purpose of Pmax and Pmin is to test the multizone carrier near the extremes to which the multizone carrier is likely to be used so that the carrier may be mathematically characterized between these values. Thus, Pmax is preferably made as high, and Pmin made as low, as possible to characterize the widest range of expected pressure values without using extreme values that are not representative of the multizone carrier in its normal range of operation.

Preferably, every other zone in the multizone carrier is pressurized to the same pressure, e.g., a three-zone carrier would have a Pmax, Pmin and Pmax pattern for zones 1, 2 and 3 respectively as illustrated in FIG. 2. Once the multizone carrier has been,pressurized as desired (Pmax, Pmin, Pmax pattern in this example) a first wafer is polished. A first removal profile across a diameter of the front surface of the wafer may then be measured (step 1001). The removal profile may be measured using a metrology system from KLA-Tencor of San Jose, Calif. such as the P2 or other systems may be used. For example, non-destructive contact techniques such as direct contact resistance measurement (i.e. a multi-point probe); mechanical step height (i.e. a profilameter); electrical snake pattern test for line resistance; and the like may also be used. The above are non-limiting examples of applicable measurement techniques, and others are also useful.

Figure 5:
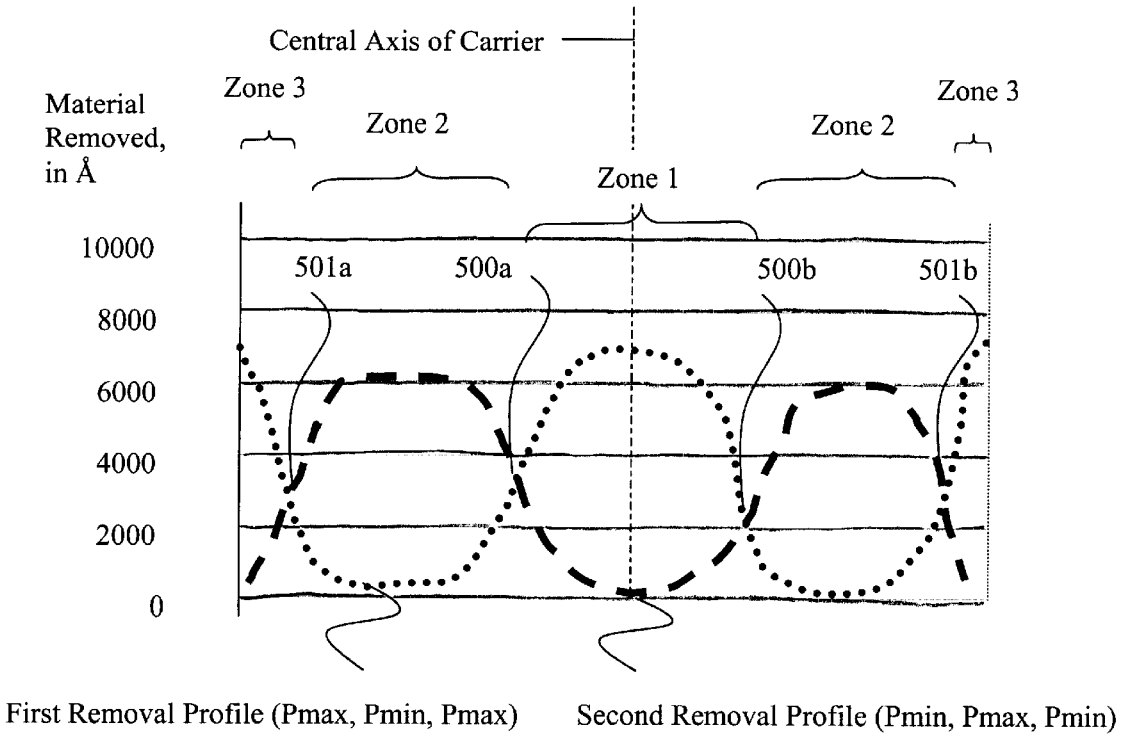
FIG. 5 is a chart illustrating zone locations by the amount of material removed by a three-zone carrier under two separate conditions.

An example first removal profile using the multizone carrier in a Pmax, Pmin, Pmax pattern is illustrated in FIG. 5. As expected, more material was removed in zones 1 and 3 with Pmax pressure than in zone 2 with Pmin pressure. It should be noted that the amount of material removed may be divided by the time it took to remove the material to produce an average material removal rate. Thus, the material removal profile is proportional to the material removal rate.

The relationship between the material removal rate and the pressure applied may generally be estimated by Preston's equation that states:

Removal Rate=Coefficient*Applied Pressure*Velocity

Thus, the removal rate profile of material from the front surface of the wafer will generally be proportional to the pressure applied within a range of operable pressures for the multizone carrier.

The multizone carrier may then be pressurized in a pattern (preferably Pmin, Pmax, Pmin) opposite the pattern used to polish the first wafer (step 1002). A second wafer may then be polished using this new pattern and a second removal profile measured across a diameter of the front surface of the second wafer (step 1003). An example of a second removal profile is shown together with an example of the first removal profile in FIG. 5.

The locations of the intersections 500*a*, 500*b*, 501*a* and 501*b* between the first removal profile and the second removal profile may be used to determine the length of the radius for each zone in the multizone carrier (step 1005). Improved accuracy may be obtained by subtracting the minimum value (min) in the first and second removal profile from the data in the first and second removal profile respectively, and then normalizing the first and second removal profiles (step 1004). This will result in all data points being in the range between 0 and 1 inclusive. As a specific example, the normalized removal rates for each removal profile may be found as:

$$RR_n(i) = \frac{RR(i) - min}{max - min}$$

where $RR_n(i)$ is the normalized removal rate profile;

RR(i) is the original removal profile (proportional to the removal rate profile);

min is the minimum data point in RR(i); and max is the maximum data point in RR(i).

The radius for each zone may be found as the average of two points of intersection symmetrical about the center of the carrier (e.g., 500*a* & 500*b* or 501*a* & 501*b*) for the normalized removal profiles (step 1006).

Model with Linear Transition

Figure 3:
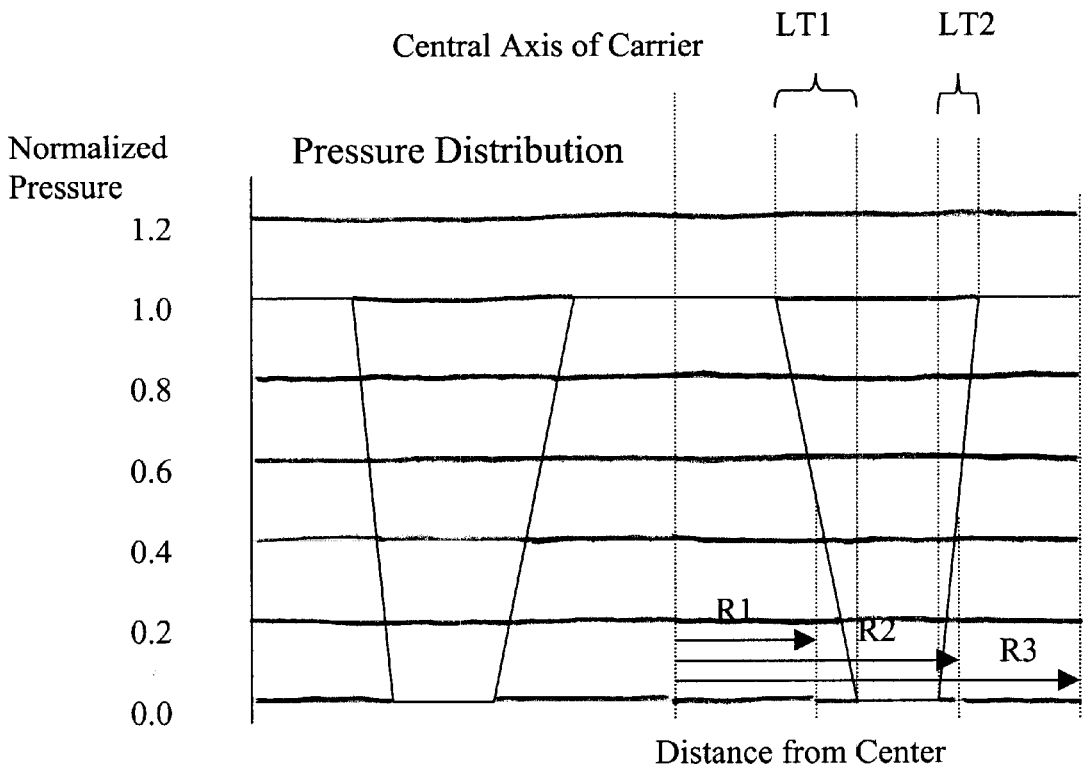
FIG. 3 is a Pressure Distribution chart illustrating a Model with Linear Transition of a possible pressure distribution on the front surface of a wafer.

FIG. 3 illustrates another model for mathematically characterizing a multizone carrier having three zones. The previously discussed Model without Transition assumes that the pressure on the front surface of the wafer is directly proportional to the pressure applied by each zone of the multizone carrier. While this assumption simplifies the Model without Transition, it also introduces inaccuracies in the model by ignoring the pressure gradients in the transition area between zones. The Model with Linear Transition acknowledges the fact that if there is a pressure gradient between carrier zones, the pressure on the front surface of the wafer will have a relatively smooth transition between zones. Thus, the pressure on the front surface of the wafer may be modeled as being uniform with the pressure applied to the back surface of the wafer with the exception of the transitional areas between zones.

Figure 6:
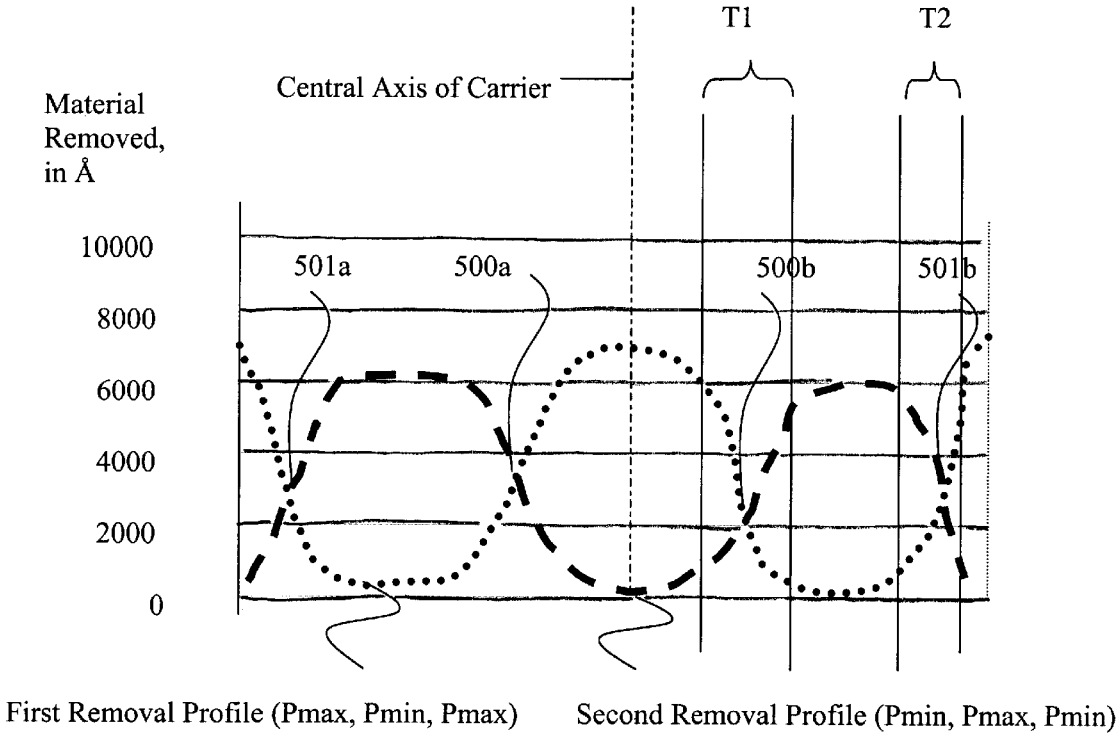
FIG. 6 is a chart illustrating transition distance between zones by a three-zone carrier under two separate conditions.

This model uses the steps discussed in the Model without Transition to also obtain the radius of the zones. However, the radius for each zone for this model is used to determine the middle of a transition area. Transition distances LT1 and LT2 in FIG. 3 may be found by determining the transition distances T1 and T2, respectively, for the first and second removal profile shown in FIG. 6.

If a zone is smaller than the combination of half the transition distance from both sides of the zone, the pressure within the zone might never reach the pressure for that zone. For example, in the case where both neighboring zones are above or below the zone, the zone's pressure will likely never be reached. In the case where one neighboring zone is above and the other neighboring zone is below, the zone's pressure will likely only be reached transitionally.

The process thus far has allowed the number of zones, geometry of zones and transition distance between zones to be found empirically. While this is the preferred approach due to its demonstrated response in actual practice, the number of zones and geometry of zones may also be found by examining the carrier or the drawings for the carrier. The transition distance, if not found in the preferred empirical method, may also be based on judgment or past experience.

Model with Exponential Transition

Figure 4:
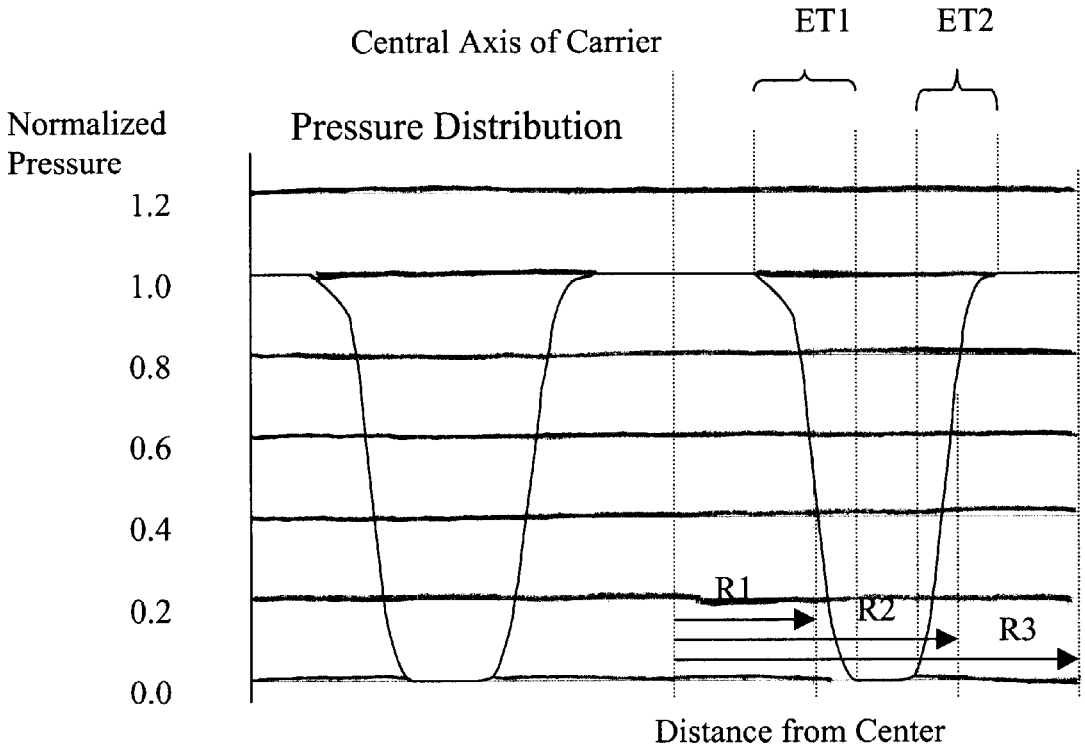
FIG. 4 is a Pressure Distribution chart illustrating a Model with Exponential Transition of a possible pressure distribution on the front surface of a wafer.
Figure 7:
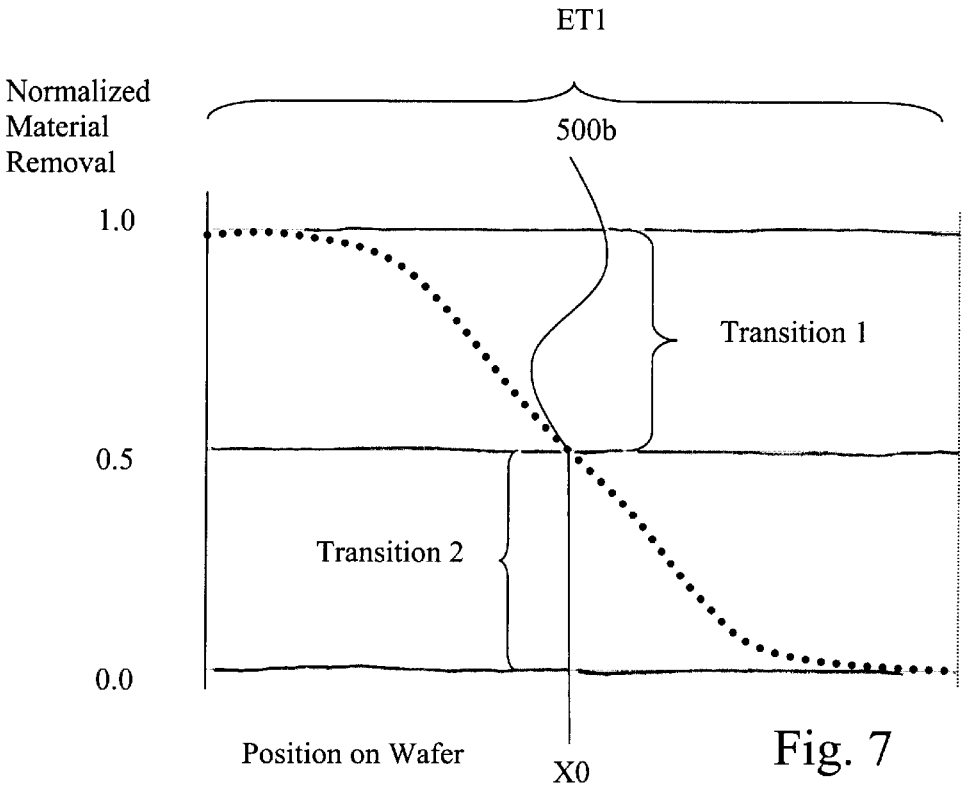
FIG. 7 is a chart illustrating an expanded view of a transitional area illustrated in FIG. 5*a;*
Figure 8:
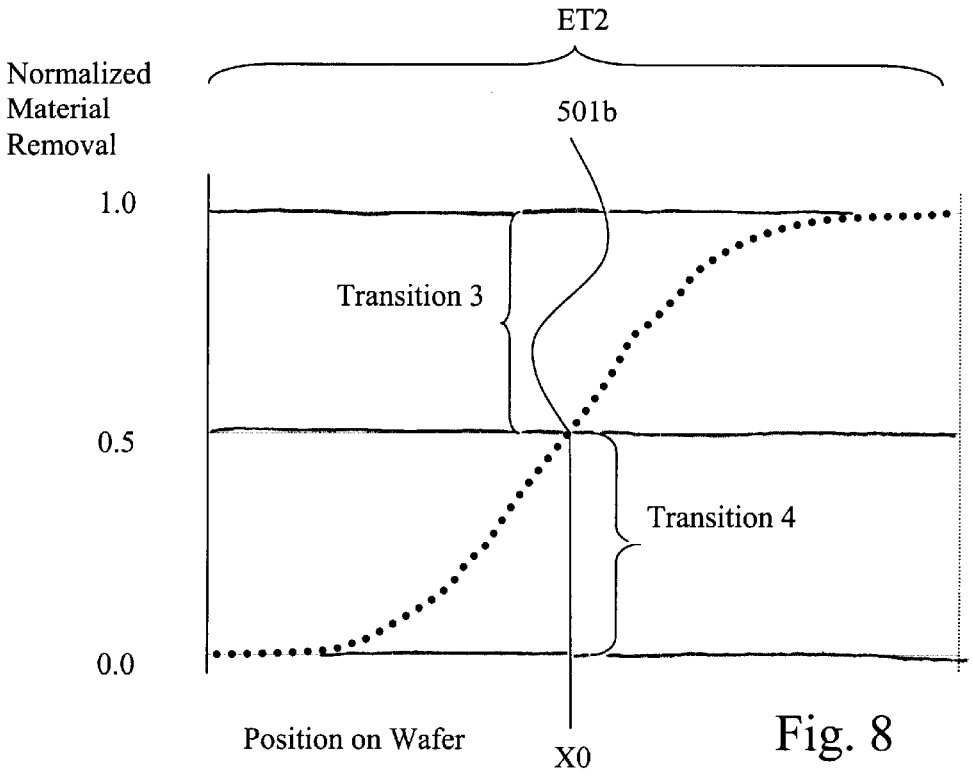
FIG. 8 is a chart illustrating an expanded view of a transitional area illustrated in FIG. 5*a;*

FIG. 4 represents the Model with Exponential Transition. This model is similar to the Model with Linear Transitions between zones, but mathematically characterizes the data in the transitional areas exponentially. The Model with Exponential Transition acknowledges the fact that in general the pressure on the front surface of the wafer in a transitional area exponentially approaches, in each direction, the pressures within the neighboring zones. Thus, the pressure on the front surface of the wafer may be modeled as being uniform with the pressure applied to the back surface of the wafer with the exception of the transitional areas between zones. FIGS. 7 and 8 show expanded views of example transitional areas ET1 and ET2. The expected pressure on the front surface of a wafer in the transitional area using this model may be found as described below.

Figure 9:
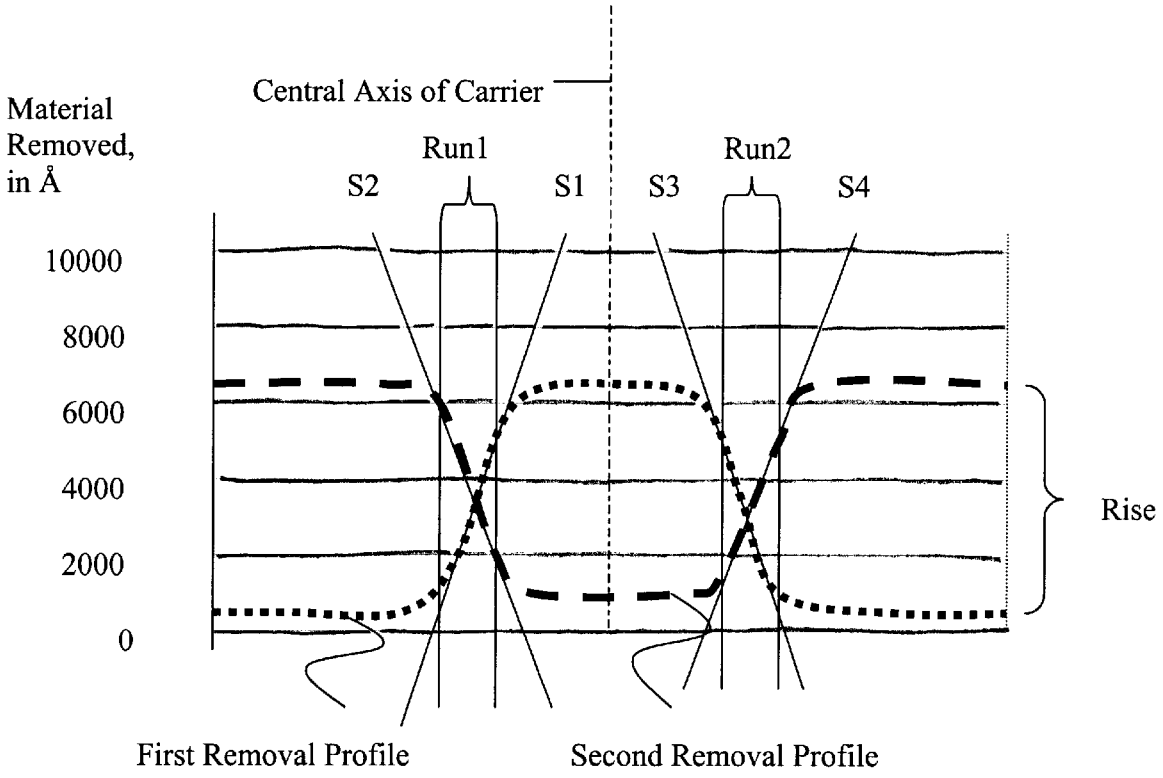
FIG. 9 is a chart illustrating four possible slopes that may be found per zone.

FIG. 9 shows an expanded view of a first and second removal profile illustrating two transition areas for a central zone of a multizone carrier. A slope (S1) for the first removal profile and a slope (S2) for the second removal profile may be calculated by dividing the ran (Run1) into the rise (Rise). Since each zone, except for the outermost zone, has two transition distances symmetrical about the center axis of the carrier, another two slopes (S3 & S4) may b found at Run2 for the first and second material removal profiles.

Alternatively, two equations may be found, one that describes the data for the fir material removal profile and another equation that describes the data for the second material removal profile. Known methods, for example least squares, may be used to determine equations that mathematically describe the data in both profiles. To simplify the process in determining the equations, the equations may be based on only the data in the transitional area. A derivative for the first equation and a derivative for the second equation may then be found. Inputting the two points of intersection for each outer diameter of a zone, one at a time, into the two derivatives, one at a time, produces four slopes (S1, S2, S3 & S4).

The absolute value of the slopes (S1, S2, S3 & S4), found by either method, may be averaged to determine an average absolute value for the derivative of the removal rate at the middle point between neighboring zones $RR^1(X\mathbf{0})$ (step 1007). This value may be used to mathematically characterize the transitional areas illustrated in FIGS. 7 and 8. Transitional areas may be descending, as shown in FIG. 7, or ascending, as shown in FIG. 8. The transitional areas are preferably broken-up, for mathematical purposes, into a transition 1 and a transition 2 area for descending transitional areas and a transition 3 and a transition 4 for ascending transitional areas. All descending and ascending transitional areas between zones in the multizone carrier may be mathematically characterized as follows:

Transition 1 may be mathematically characterized as:

$$RR1(X) = \left[0.5 + 0.5 * \left(1 - e^{\frac{-(X0-X)}{K}}\right)\right] * (HN - LN) + LN$$

Transition 2 may be mathematically characterized as:

$$RR2(X) = \left[0.5 * e^{\frac{-(X-X0)}{K}}\right] * (HN - LN) + LN$$

Transition 3 may be mathematically characterized as:

$$RR3(X) = \left[0.5 + 0.5 * \left(1 - e^{\frac{-(X-X0)}{K}}\right)\right] * (HN - LN) + LN$$

Transition 4 may be mathematically characterized as:

$$RR4(X) = \left[0.5 - 0.5 * \left(1 - e^{\frac{-(X0-X)}{K}}\right)\right] * (HN - LN) + LN$$

where:

$$K = \frac{0.5}{RR^1(X0)}$$

HN is the higher pressure between neighboring zones; and LN is the lower pressure between neighboring zones.

The pressure at each point on the front surface of the wafer may now be found for this model (step 1008). Once a multizone carrier has been mathematically characterized as disclosed, different pressure combinations may be mathematically input to determine an expected pressure between the front surface of the wafer and a polishing pad. Because the pressure on the front surface of the wafer is proportional to the material removal rate, an expected material removal profile may also be found.

While the invention has been described with regard to specific embodiments, those skilled in the art will recognize that changes can be made in form and detail without departing from the spirit and scope of the invention. For example, while a three zone carrier was used to describe the invention, multizone carriers having a different number of individually controllable pressure regions may be used.

We claim:

1. A method for calculating a pressure profile on a wafer for a particular combination of pressure within a first set of zones and a set of remaining zones of a multizone carrier, comprising the steps of:

a) mathematically characterizing a multizone carrier by pressurizing predetermined ones of said first set of zones and said set of remaining zones with predetermined pressures; and b.) calculating a pressure profile on a wafer in the multizone carrier.

2. The method of claim 1, wherein the step of mathematically characterizing a multizone carrier comprises the steps of:

A.) pressurizing a first set of zones in a multizone CMP carrier to a first pressure;

B.) pressurizing the remaining zones in the multizone CMP carrier to a second pressure, wherein the second pressure is greater than the first pressure;

C.) polishing a first wafer using the multizone CMP carrier after steps A & B;

D.) determining a removal profile for the first wafer;

E.) pressurizing the first set of zones in the multizone CMP carrier to a third pressure;

F.) pressurizing the remaining zones to a fourth pressure, wherein the third pressure is greater than the fourth pressure;

G.) polishing a second wafer using the multizone CMP carrier after steps E & F;

H.) determining a removal profile for the second wafer; and

I.) locating a plurality of pairs of points, symmetrical about a central axis of the carrier, at the intersections between the removal profile for the firs wafer and the removal profile for the second wafer, wherein each pair of symmetrical points define a position of an outer diameter of a single zone in the multizone carrier.

3. The method of claim 1, wherein the step of mathematically characterizing the multizone carrier uses a model without transition.

4. The method of claim 1, wherein the step of mathematically characterizing the multizone carrier uses a model with linear transition.

5. The method of claim 1, wherein the step of mathematically characterizing the multizone carrier uses a model with exponential transition.

6. The method of claim 1, further comprising the step of:

d.) calculating a removal profile using the pressure profile and Preston's equation.

7. A method for mathematically characterizing a multizone CMP carrier, the multizone CMP carrier including a first set of zones and a second set of remaining zones, comprising the steps of:

a) pressurizing the first set of zones in a multizone CMP carrier to a first pressure;

b) pressurizing the remaining zones in the multizone CMP carrier to a second pressure, wherein the second pressure is greater than the first pressure;

c) polishing a first wafer using the multizone CMP carrier after steps a & b;

d) determining a removal profile for the first wafer;

e) pressurizing the first set of zones in the multizone CMP carrier to a third pressure;

f) pressurizing the remaining zones to a fourth pressure, wherein the third pressure is greater than the fourth pressure;

g) polishing a second wafer using the multizone CMP carrier after steps e & f;

h) determining a removal profile for the second wafer; and i) locating a plurality of pairs of points, symmetrical about a central axis of the carrier, at the intersections between the removal profile for the second wafer, wherein each pair of symmetrical points define a position of an outer diameter of a single zone in the multizone carrier.

8. The method of claim 7 wherein the first set of zones in the multizone CMP carrier comprises alternating zones.

9. The method of claim 8 wherein the second pressure is about equal to the third pressure and the first pressure is about equal to the fourth pressure.

10. The method of claim 9 wherein the second and third pressure are about equal to, or greater than, a pressure to produce a desired production removal rate and the first and fourth pressure are about equal to a pressure to produce about a minimum removal rate.

11. The method of claim 9 further comprising the steps of:

j.) subtracting a minimum value within the removal profile for wafer 1 from the removal profile for wafer 1;

k.) subtracting the minimum value of the removal profile for wafer 2 from the removal profile for wafer 2; and l.) normalizing the removal profile for wafer 1 and the removal profile for wafer 2.

12. The method of claim 8 further comprising the steps of:

j.) calculating a first derivative for the removal profile for wafer 1 and wafer 2 at each point of intersection between the removal profile for wafer 1 and wafer 2; and k.) averaging the absolute value of the first derivatives for pairs of symmetrical points that define the outer diameter of a zone to determine exponential transition between zones.

* * * * *